US009465310B2

(12) United States Patent
Deroover et al.

(10) Patent No.: US 9,465,310 B2
(45) Date of Patent: Oct. 11, 2016

(54) LIQUID TONER DISPERSION AND USE THEREOF

(71) Applicant: Xeikon IP BV, Eede (NL)

(72) Inventors: Geert Gaston Paul Deroover, Lier (BE); Lode Erik Dries Deprez, Wachtebeke (BE); Werner Jozef Johan Op de Beeck, Putte (BE)

(73) Assignee: Xeikon IP BV (NL)

( * ) Notice: Subject to any disclaimer, the term of this patent is extended or adjusted under 35 U.S.C. 154(b) by 3 days.

(21) Appl. No.: 14/594,344

(22) Filed: Jan. 12, 2015

(65) Prior Publication Data

US 2015/0198903 A1 Jul. 16, 2015

(30) Foreign Application Priority Data

Jan. 14, 2014 (NL) ..... 2012086

(51) Int. Cl.
*G03G 9/135* (2006.01)
*G03G 9/08* (2006.01)

(52) U.S. Cl.
CPC ..... *G03G 9/135* (2013.01); *G03G 9/0804* (2013.01); *G03G 9/0806* (2013.01); *G03G 9/1355* (2013.01)

(58) Field of Classification Search
CPC .... G03G 9/135; G03G 9/1355; G03G 13/11; G03G 9/0806; G03G 9/0804
USPC ..... 430/114, 115, 137.22
See application file for complete search history.

(56) References Cited

U.S. PATENT DOCUMENTS

| | | | | |
|---|---|---|---|---|
| 4,224,212 | A * | 9/1980 | Topham | B01F 17/005 106/31.75 |
| 4,962,150 | A * | 10/1990 | Allen | C08G 81/00 524/602 |
| 5,230,834 | A * | 7/1993 | Gutierrez | C08F 8/30 508/236 |
| 5,622,804 | A * | 4/1997 | Matsuoka | G03G 9/12 430/115 |
| 2005/0009952 | A1* | 1/2005 | Qian | C08F 259/02 523/160 |
| 2007/0258731 | A1* | 11/2007 | Miura | G03G 9/132 399/238 |
| 2008/0131807 | A1 | 6/2008 | Teshima et al. | |
| 2011/0249990 | A1 | 10/2011 | Izawa et al. | |
| 2012/0009516 | A1* | 1/2012 | Ganapathiappan | G03G 9/122 430/117.1 |
| 2012/0244468 | A1* | 9/2012 | Asai | C08G 63/08 430/116 |
| 2013/0059969 | A1* | 3/2013 | Thetford | C09D 7/02 524/539 |

FOREIGN PATENT DOCUMENTS

| | | |
|---|---|---|
| EP | 0278785 B1 | 5/1996 |
| EP | 2685322 A1 | 1/2014 |

* cited by examiner

*Primary Examiner* — Christopher Rodee
(74) *Attorney, Agent, or Firm* — The Webb Law Firm

(57) ABSTRACT

A liquid toner dispersion provided with marking particles comprising a pigment and a polyester based resin, the dispersion comprising a nonpolar organic carrier liquid and a hyperdispersant comprising a graft copolymer provided with an anchor group comprising an amine-functionalized polymer onto which at least one stabilizing group is grafted, wherein a first stabilizing group and a second stabilizing group are coupled to the anchor group, wherein the first stabilizing group is a polyolefin and the second stabilizing group is hydroxylated fatty acid compound.

19 Claims, 2 Drawing Sheets

LIQUID TONER DISPERSION AND USE THEREOF

CROSS-REFERENCE TO RELATED APPLICATION

Figure 1:
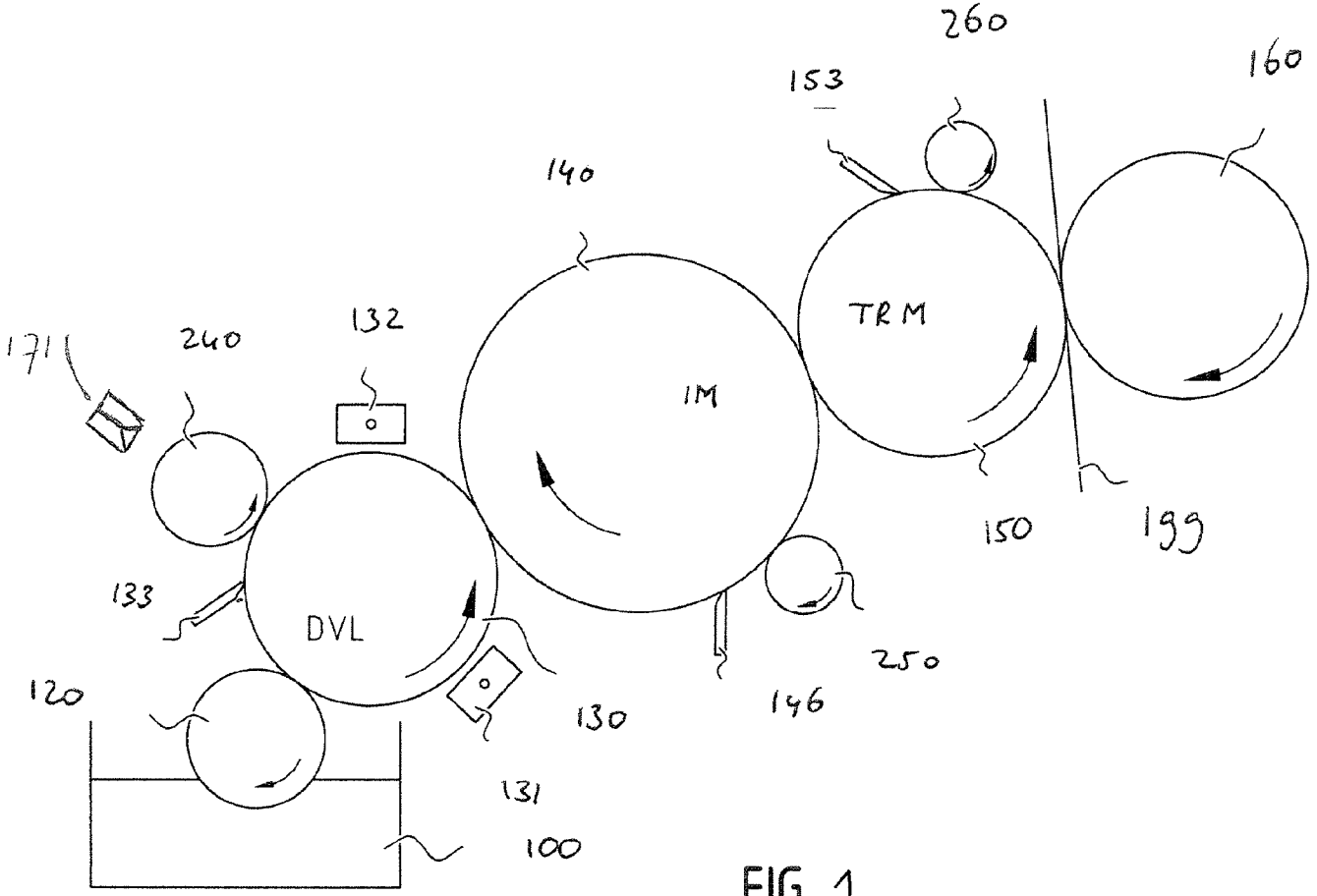

This application claims priority to The Netherlands Patent Application No. 2012086 filed Jan. 14, 2014, the disclosure of which is hereby incorporated in its entirety by reference.

FIELD OF THE INVENTION

The invention relates to a liquid toner dispersion comprising a copolymer of an amine-functionalized polymer onto which hydroxylated fatty acid compound is grafted.

The invention also relates to the preparation of such a liquid toner dispersion.

The invention further relates to the use of said dispersion in a printing process.

BACKGROUND OF THE INVENTION

Liquid toner dispersion is a stabilised dispersion for use in a printing process. It differs from other ink dispersions such as dispersions for offset printing and inkjet compositions, on the basis of the particles it contains. Whereas an inkjet composition generally comprises pigment as such, the liquid toner dispersion comprises marking particles comprising pigment that is mixed with a polyester resin binder. The resulting particles suitably have a diameter in the range of 0.5-5.0 μm whereas pigment particle sizes in inkjet- and offset-printing are below 500 nm.

In such liquid toner printing process a digital printing apparatus as described in US patent application no 2011/0249990 can be used. The liquid toner dispersion is typically transferred from feeding means, such as a feed roller to a first member via a second member to a substrate. Those members are for instance cylindrical rollers, but may have another form. The first member is also known as a development roller. The second member is also referred to as a photoconductor. Further intermediate members may be present, for instance between the photoconductor and the substrate.

One of the complexities of the liquid toner process is the stability of the liquid toner dispersion. In relation thereto, a dispersant is used. The use of hyper-dispersants seems beneficial. These hyperdispersants comprise an anchor group and a stabilizing group. The anchor group is anchored on the polymer particle surface by single-point or multipoint anchoring. Both acrylates and amines are known as anchor group. The stabilising group grafted onto the anchor group extends in non-aqueous system to provide steric stability. One specific example of a known hyperdispersant is a graft copolymer with a polyethylene-imine (PEI) as the anchor group and poly(12-hydroxy stearic acid) as the stabilising group in aliphatic hydrocarbon continuous phases. This graft copolymer of a hydroxylated fatty acid is commercially available, for instance from Lubrizol under the tradename Solsperse™.

Structurally different dispersing agents are known for other applications, such as the dispersing of the pigment as such. This dispersing is typically carried out prior to or during mixing with a binder resin to form the marking particles. For instance, US2012/0009516A1 discloses a group of dispersing agents with an anchoring group comprising a polyalkylene-imine segment, to which stabilising groups are bound. The stabilizing groups are thereto provided with linkage groups, that generally contain a carboxylic group. US'516A1 discloses carboxyl (CO), anhydride (COO) and amide (CONH) linkage groups. Upon bonding, an imide or amide is formed between the carboxyl of the linkage group and the amine of the polyalkylene-imine segment. The said segment is present in a linear molecule with aliphatic parts on both sides of the polyalkylene-imine segment. The aliphatic parts—alkyl or polyalkylene, such as polyisobutylene—are introduced for providing sufficient dispersion in the aliphatic solvent used for the pigment dispersion. Additionally, the stabilising groups are also an alkyl or aryl group. The examples of US'516A1 refer to amine dispersant obtained from Lubrizol, of which the molecular structure is not disclosed.

It has been found by the inventors of the present invention in the course of investigations in relation to liquid toner dispersions, that the stability requirements are manifold. The dispersion should evidently be stable after preparation, i.e. during storage and upon application to the first member. But the liquid toner process further requires that the fusing is not hindered or disturbed by the dispersant. Moreover, the dispersion should not be sensitive to an artefact called caking, after charging the dispersion.

In order to transfer to the liquid toner dispersion from the first member to the second member, the liquid toner dispersion is typically charged. Due to this charging process, the transfer may be selective, such that merely a desired image is transferred from the first member to the second member. Charging of the liquid toner dispersion however also has an impact on the stability of the dispersion. As a consequence hereof, an issue occurs that is known as 'caking'. Particularly, polymer 'marking' particles in the dispersion tend to form lumps in the dispersion resulting in a liquid with a non-uniform distribution of marking particles. This caking often results in an increase of the viscosity of the liquid dispersion. This viscosity increase is significant, and could be a tenfold increase or even more. Liquid developer dispersion that shows caking cannot be used for printing as such and needs to be treated first in order to re-obtain a homogeneously dispersed liquid toner which has similar physical properties like conductivity and viscosity as the starting liquid developer dispersion. It is thought that caking is the result of marking particles that come so close into each other's neighborhood on the developing member, so that they start to feel each other's presence and start interacting with each other. Caking can also be the result of injecting charge and applying high shearing forces which are typically present when a thin layer of liquid developer dispersion passes through a very narrow gap between two (rotating) members of the printing apparatus or huge (microsized) mechanical interaction like a cleaning blade scraping on a circular surface.

It is therefore an object of the invention to obtain a liquid toner dispersion that would meet all needs. The hyperdispersant should in particular be capable of stabilizing the initial liquid toner dispersion, but it should not disturb the fusing process and it should not give rise to significant caking, at least less than the known Solsperse™ dispersants, such as Solsperse™ 11000 and Solsperse™ 13940.

SUMMARY OF THE INVENTION

According to a first aspect, this object is achieved in a liquid toner dispersion provided with marking particles comprising a pigment and a preferably a polyester based resin, said dispersion comprising a nonpolar organic carrier liquid and a specific hyperdispersant, i.e. a graft copolymer having an anchor group comprising an amine-functionalized polymer onto which stabilising groups are grafted, wherein a first stabilizing group and a second stabilizing group are coupled to the anchor group, wherein the first stabilizing group is a fatty acid compound and the second stabilizing group is a polyolefin.

According to a second aspect, the invention relates to the preparation of a liquid toner dispersion of the invention, comprising the steps of the provision of the amine functionalized polymer; the coupling of a polyolefin and a fatty acid compound onto the amine-polymer, under formation of a hyperdispersant as a graft copolymer, and the mixing of the hyperdispersant with carrier liquid and marking particles.

According to again a further aspect, the invention relates to a method of digitally printing an liquid toner dispersion, wherein use is made of a first member that rotates and is in rotational contact with a further member during printing, which printing method comprises the steps of: (1) charging an liquid toner dispersion of the invention to facilitate transfer thereof from the first member to the further member; (2) transferring the charged liquid toner dispersion from a surface of the first member via the at least one further member to a substrate, wherein excess liquid toner dispersion remains present on the first member after said transfer, and wherein the liquid toner dispersion is heated upon transfer from a further member to the substrate, so as to achieve fusing of the ink onto the substrate, and; (3) removing, at least substantially, the excess liquid toner dispersion from the surface of the first member by means of a removal device.

According to a further aspect, the invention relates to the graft copolymer as such, comprising an anchor group of amine-functionalized polymer to which are coupled a first stabilizing group which is or contains a fatty acid compound and a second stabilizing group which is or contains a polyolefin.

According to again a further aspect, the invention relates to the use of the copolymer for stabilisation of a liquid toner dispersion.

Particularly, the graft copolymer may be used as a hyperdispersant for selective stabilisation of a dispersion, such as a dispersion of marking particles in an organic liquid, more preferably an organic non-polar liquid, for instance a mineral oil. Due to the use of the graft copolymer, stabilisation occurs during storage and on application of the dispersion on a first member, particularly at room temperature, while the dispersion disappears on heating the dispersion in the course of a fusing step. The organic liquid is more generally referred to as a carrier liquid.

The inventors have unexpectedly found, in investigations leading to the invention that hyperdispersants with two structurally different stabilizing groups are beneficial. Without intended to be bound thereby, the inventors see as an explanation for the beneficial behaviour that the first and the second stabilizing group each work best in one specific situation. Particularly, the first stabilizing group of a polyolefin seems less sensitive for the effect of charging, reducing caking issues, while the fatty acid compound appears to enable the fusing.

It will be understood by the skilled person that an optimum choice of the anchor groups and the stabilising groups further depends on the choice of carrier liquid (also referred to as solvent) and marking particles. The mutual compatibility of the different chemical group from anchoring and stabilising part with marking particles and carrier liquid can be estimated on the basis of the Hansen solubility parameters, as known from Hansen Solubility Parameters in Practice, 4th Edition; Steven Abbott, Charles M. Hansen and Hiroshi Yamamoto; ISBN 978-0-9551220-2-6, and can be checked with regular experimental tests According to the invention, both the first and the second stabilising groups are grafted onto the anchor group. Grafting the stabilising groups onto the anchor group is an efficient technique for forming the copolymer. Moreover, a major benefit of grafting is that the stabilising groups have a free end that may extend into the carrier liquid. This provides optimum stabilisation. If the stabilizing group does not contain a reactive linkage group (f.i. acid, anhydride or acyl halogenide), the stabilizing group is suitably modified prior to grafting. Suitably, the polyolefin stabilizing group is modified to contain an anhydride, for instance a succinic anhydride. The fatty acid compound is typically not modified, as it contains an acid group by itself.

It is observed that in the context of the invention, the term 'graft copolymer' refers both to a polymer wherein a covalent amide binding is formed, and to a precursor polymer thereof, wherein the binding is based on acid-base interaction of the positively charged amine and the negatively charged carboxylic group. Such an acid-base interaction remains localized due to the nonpolar organic carrier liquid of the dispersion, and therefore effectively functions as a binding. The acid-base interaction is the consequence of a preferred synthetic method, in which the acid-base pair is prepared, which is thereafter converted into a covalent binding, for instance by heat treatment. However, it is not feasible to determine to which extent the conversion of the acid-base binding to the covalent binding proceeds. Moreover, it is not excluded to prepare the graft polymer of the present invention in another manner.

Preferably the amine-functionalized polymer has a weight-average molecular mass of less than 40,000, preferably less than 10,000 more preferably less than 3000 g/mol, even more preferably less than 1500 g/mol, and most preferably even less than 1000 g/mol. The use of aliphatic amines is preferred, and most preferred are linear amines. As shown by the experimental data, the use of a relatively small anchor group turns out to function well in the invention; it appears that the behaviour is relatively insensible to the weight of the anchor group, as long as it is not too high. A higher average molecular mass, for instance above 15,000 g/mol was found to increase caking issues. It is surprising that good behaviour was also found with very small anchor groups having a molar mass of at most 1000 g/mol.

Examples of preferred amine-functionalized polymers are polyamines, for instance polyallylamines and poly(alkylene) imines, wherein the alkylene is chosen from ethylene, propylene, isopropylene, butylene, isobutylene and any other butylene isomer. The amine-functionalized polymer may further be a copolymer.

The first stabilising group is most generically a fatty acid compound, either as a monomer (polymerisation degree of 1) or as a polymer (a polyester). Suitably, the chain length of the fatty acid is in the range of C12-C26, preferably C16-C20, more preferably C18. Preferably, the fatty acid is branched, so as to improve the steric effect. More preferred is the use of a hydroxylated fatty acid, which has a polarity that is higher than that of a typical carrier liquid such as a mineral oil. Good results have been obtained with hydroxylated stearic acid, such as 12-hydroxylated stearic acid and 4-hydroxylated stearic acid, and with the unsaturated ricinoleic acid. These fatty acids both have a C18-chain length.

Further suitable fatty acids are for instance butolic acid (6-hydroxytetradecanoic acid), convolvulinic acid (11-hydroxytetradecanoic acid), jalapinolic acid (11-hydroxyhexadecanoic acid), lesquerolic acid (14-hydroxy-eicos-cis-11-enoic acid), isoricinoleic acid (9-hydroxy-octadeca-cis-12-enoic acid), dimorphecolic acid (9-hydroxy-octadeca-trans-10, trans-12-dienoic acid), helenynolic acid (9-hydroxy-octadeca-trans-10, cis-12-dienoic acid), coriolic acid (13-hydroxy-octadeca-cis-9, trans-11-dienoic acid), auricolic acid (14-hydroxy-eicos-cis-11, cis-17-dienoic acid), ximenynolic acid (8-hydroxy-cis-11-octadecene-9-ynoic acid), isanolic acid (8-hydroxy-cis-17-octadecene-9,11-diynoic acid). The oligomers of hydroxylated fatty acids are preferred in view of their enhanced polarity relative to non-hydroxylated fatty acids.

The second stabilizing group is most generically a polyolefin. The polyolefin suitably comprises side-chains to its main chain. Such a structure may for instance be prepared by starting from other monomers than ethylene, such as propylene, any butylenes, any pentylene or in a copolymerisation of ethylene and a further olefin, such as butene, hexene, or another C3-C8 monomer. A preferred polyolefin is based on isobutylene monomers. The polyolefin for instance has a weight-average molar mass of 500-2000 g/mol, for instance 800-1500 g/mol. It is not excluded that the polyolefin is unsaturated, i.e. comprises one or more double bonds. Furthermore, the polyolefin could be halogen-substituted. This is however not preferred in view of environmental regulations on waste disposal of halogenated compounds. For grafting, the polyolefin may be provided with a carboxyl group, preferably on at least one of its ends. The carboxyl group is more preferably an anhydride, though an acid or acyl halogenide may also be feasible.

The length of the first stabilizing group may be substantially different than that of the second stabilizing group. The length of the first stabilizing group is suitably expressed on the basis of its polymerisation degree. Generally, the polymerisation degree varies between 1 and 12. Suitably, the first stabilising group has a polymerisation degree of 1-5, preferably 1-3. It is believed that the presence of fatty acid compounds with a low degree of polymerisation is beneficial for the behaviour during fusing at increased temperature, where the dispersing agent may not inhibit or disturb the fusing of marking particles.

The weight ratio between the first and the second stabilizing group is suitably between 0.25 and 2. Such ratio was found to result in a relatively low viscosity after caking, and positive results on caking. The weight ratio is herein defined as the total weight of the substituted first stabilizing groups relative to the total weight of the second stabilizing groups.

Since the binding of the stabilising group to the amine function in the anchoring group ('binding site') is a statistical process, the number of stabilising groups bound to an anchoring group may well vary per molecule. Evidently, it is further dependent on the molar ratio between binding sites and stabilising groups. The effective, average ratio of bound stabilising groups to binding sites is the degree of substitution.

The degree of substitution of the amine groups of the anchor groups may vary. Good results have been obtained with widely varying substitution degrees, i.e. both in the range of 10-20% and in the range of 80-100%, as well as in any range in between. In case of a high degree of substitution, it is preferred that one of the stabilising groups, suitably the first stabilising group, has a low degree of polymerisation, for instance 1-3, and suitably 1-2.

Suitably, all the first stabilising groups are built up from the same hydroxylated fatty acid. This may be practical from synthetic perspective, but it is not necessary. The fatty acid polymer may alternatively contain different fatty acids, such as both unsaturated and saturated fatty acids.

The use of the dispersion in a liquid toner process is believed to require a balance between adsorption to the surface of the marking particles comprising toner resin on the one hand, and desorption into the carrier liquid on the other hand. It is believed that this is also an issue of kinetics. Therefore, use is made of a two chemically different stabilising groups, i.e built up of mutually different chemical compounds. Suitably, at least one of the stabilising groups has a chain length of at least 30 carbon atoms, more preferably at least 40 carbon atoms. In such a manner, the stabilising groups effectively enter into the carrier liquid. Moreover, smaller anchoring groups are considered to work better. Furthermore, it appears beneficial that not all binding sites of the anchor groups are substituted with stabilising groups, and particularly not with stabilising groups with significant length. According to one embodiment, the degree of substitution of the anchor group with first stabilising groups with significant length, for instance a degree of polymerisation of 5-8, is relatively low, for instance less than 50%.

Furthermore, in the light of the desired balance between adsorption and desorption, the use of hydroxylated fatty acid compounds in combination with a suitable carrier liquid such as a mineral oil, is preferred. In this embodiment, the first stabilising groups are more polar than the carrier liquid and thus do not show perfect matching. This is deemed preferable in order to prevent reduced adsorption of the hyper-dispersant to the marking particles.

The overall weight-average molecular weight of the graft copolymer is suitably in the range of 1500-150,000 g/mol. Preferably, the weight-average molecular weight is in the range of 2000-20,000, more preferably in the range of 2500-18,000 and most preferably in the range of 3000 to 10,000 g/mol.

The graft copolymer may further contain a third stabilising group, which is for instance an acetylene-based compound, more particularly a polymer of an acetylene monomer, resulting in a double bond in the chain.

The liquid dispersion of the invention is preferably used in a digital printing process as described in Applicant's earlier non-prepublished patent applications EP 131625774 (improved toner removal), EP 121866768 (fusing), NL 2011067 (roller fuser sponge), which are included herein by reference.

BRIEF INTRODUCTION OF THE FIGURES

Figure 2:
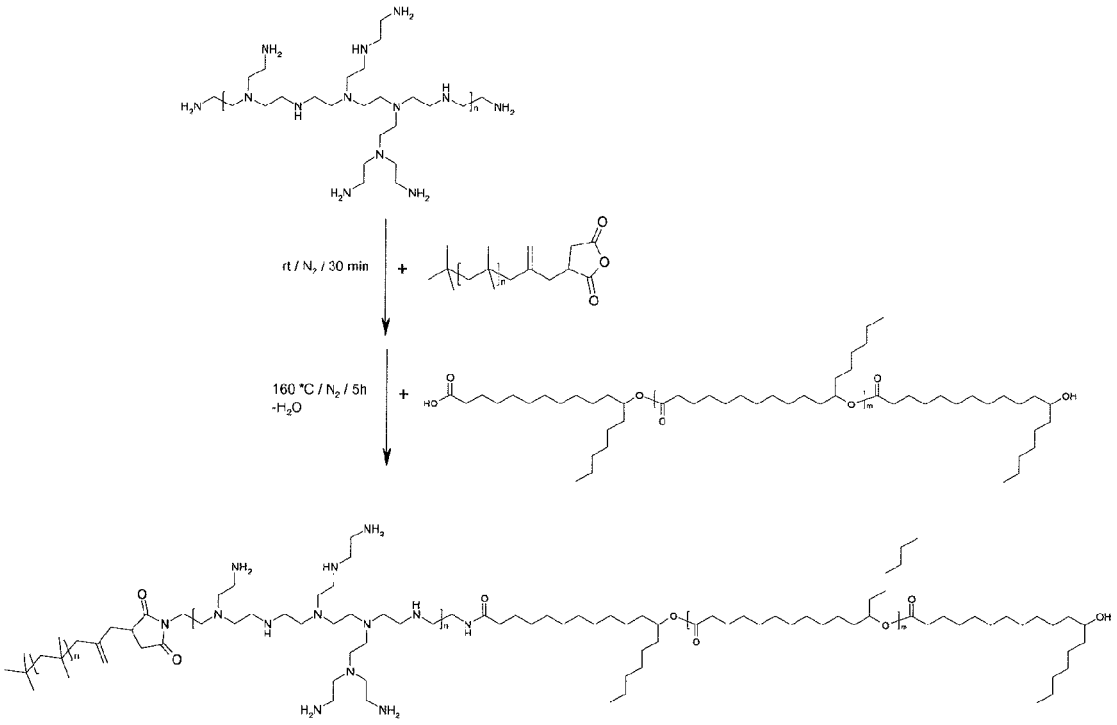

These and other aspects of the invention will be further elucidated with reference to the figures, wherein:

FIG. 1 is a schematic view illustrating a first embodiment of the invention; and FIG. 2 shows the reaction equation for the synthesis of the dispersing agent of the present invention.

DETAILED DESCRIPTION OF ILLUSTRATED EMBODIMENTS

The Figures are not drawn to scale and purely diagrammatical in nature. Equal reference numerals in different Figures refer to equal or corresponding features.

FIG. 1 illustrates diagrammatically a first embodiment of a digital printing apparatus of the invention, comprising a reservoir 100, a feed member 120, a developer member 130, an imaging member 140, a intermediate member 150 and a support member 160. A substrate 199 is transported between intermediate member 150 and support member 160. Both the development member 130 and the imaging member 140 and also the intermediate member 150 can function as the first member according to the invention, and are shown to be provided with a removal device 133, 146, 153, and with treatment means 132, 240; 250; 260. Without loss of generality, the aforementioned members are illustrated and described as rollers, but the skilled person understands that they can be implemented differently, e.g. as belts.

In operation, an amount of liquid developer dispersion, initially stored in a liquid developer dispersion reservoir 100, also called main reservoir, is applied via a feed member 120, to a development member 130, an imaging member 140, and an optional intermediate member 150, and finally to a substrate 199. The development member 130, imaging member 140, and intermediate member 150 all transfer part of the liquid developer dispersion 100 adhering to their surface to their successor; the part of the liquid developer dispersion 100 that remains present on the member's surface, i.e. the excess liquid developer dispersion, is removed after the transfer stage by appropriate means. The development member 130, the imaging member 140 and the intermediate member 150 may all act as the first member.

The charging of the toner on the development roll is done by charging device 131. This charging device can be a corona or a biased roll. By charging the toner the liquid developer dispersion splits into an inner layer at the surface adjacent of the development member 130 and an outer layer. The inner layer is more rich is marking particles (also referred to as toner particles) and the outer layer is richer in carrier liquid. The transition between these two layers may be gradual.

Upon transfer of the liquid developer dispersion from the development member 130 to the imaging member 140, excess liquid developer dispersion is left on the development member 130. Ideally, this excess liquid developer dispersion is present only in "non-image" areas, i.e. areas not corresponding to the image to be printed on the substrate, which is specified by the imaging member. However, it is not excluded that a thin layer remains on the development roller 130 at the area of the transferred image. The physicochemical state and the rheology of the excess liquid developer dispersion are influenced by the charging and also by the concentration of the toner particles, which may have changed i.e. increased due to loss of carrier liquid during the development step. More particularly, in one suitable embodiment, the excess liquid developer dispersion is more concentrated and shows caking. This transformation is due to the charging and to the transfer of part of the outer layer that is richer in carrier liquid.

FIG. 1 further shows a discharging corona 132 that is provided downstream of the area of the rotational contact between the developer roller 130 and the imaging roller 140. The discharging corona 132 is suitable for changing/removing the charge in the dispersion. Further, downstream of the discharge corona 132 there is provided an additional member 240. In this example, the additional member is embodied as a loosening roller, which is provided with a rubbing portion. This is useful for improvement of mixing of the excess liquid developer dispersion with the added agent or with pure carrier liquid as such in order to reduce the concentration of the compacted developer solution. The agent can be one or more dispersing agents.

As shown in this example, but that is not deemed essential, the agent or pure carrier liquid may be applied in a patternwise manner via application means 171. Such application means 171 may be inkjet printing heads and other disposal means for patterned application of a liquid. In the shown example, the spacer agent may be added to the excess liquid dispersion, pattern wise via the application means 171 and the loosening roller 240. The loosening roller 240 is, in use, in rotational contact with the development member 130. Similar loosening rollers 250, 260, which could be simply addition rollers without a dedicated rubbing portion, are present in rotational contact with the imaging member 140 and the intermediate member 150 respectively. Thereafter, a removal device is present, which most suitably is a scraper 133. The removed material is preferably recycled into fresh liquid toner.

Investigations have shown that several steps in the printing process are sensitive for failure, which may lead to errors in the image printed on the substrate, or to malfunctioning of the printing process.

A first sensitive step is the charging step 131. Marking particles in the dispersion are aligned herein due to the charging and/or the presence of an electric field typically applied at the nip between the first member and the further member, f.i. the developer member 130 and the imaging member 140. Without a proper charging and alignment, the patterned transfer from the first member to the further member will not be adequate.

A second sensitive step is the removal of the liquid toner residue that remains on the first member, such as the development roller 130, but alternatively the imaging member 140 or the intermediate member 150. As discussed above, marking particles in the liquid developer dispersion tend to form lumps in the dispersion resulting in a liquid with a non-uniform distribution of marking particles. This is called caking and often results in an increase of the viscosity of the liquid dispersion and partial jelly fractions of ink. This viscosity increase is significant and could be a tenfold increase or even more. The removal of the liquid toner residue starts then to be problematic. As a result, liquid toner residue could remain on the development roller, which constitutes a contamination and may lead to a non-uniform distribution of fresh developer dispersion resulting in a ghost image and or image quality that is not perfect, in other words incorrect. Examples of issues are density instability and incorrect reproduction of fine lines.

A third sensitive step is the fusing of the liquid toner. This fusing is to result in coalescence of the marking particles on the paper. Typically use is made of a heat treatment that takes place shortly before, during or shortly after the transfer of the dispersion to the substrate. The term 'coalescence' refers herein to the process wherein marking particles melt and form a film or continuous phase that adheres well to the substrate and that is separated from any carrier liquid. Suitably, the carrier liquid is thereafter removed in a separate step, for instance by means of rollers, by means of blowing off the carrier liquid, by means of suction. Suitably, this process occurs at "high speed", for instance 50 cm/s or more, so as to enable high-speed printing. The fusing has as a goal not to form an emulsion since an emulsion does not give a good printing image. Other means for fusing can also be used where the most of carrier liquid phase is removed by for example evaporation on a transfuse belt or by a semi-permeable belt. This has the advantage that almost no carrier liquid is left over during final fusing step favouring the coalescence of the marking particles.

In order to solve the caking issue, mechanical and chemical means may be used to clean the surface of the first member 130. The use of chemical means is however relatively limited, because the removed material is suitably recycled into fresh toner. Typically, no additives are allowed which would contaminate the fresh toner and thus have an impact on the printing process and/or the quality of the printed image.

In order to arrive at an improved printing process, the dispersion is a key element, and a difficult one. Modification of the dispersion typically influences its behaviour during charging and fusing. Modification of the dispersion also may have an impact on the behaviour of the liquid toner residue. Particularly, a dispersion that becomes unstable and inhomogeneous can give rise to a tremendous change in the rheology: a homogeneous dispersion mostly flows in its entirely, but the rheology of an inhomogeneous dispersion is in fact dependent on the two separate phases in the dispersion (the dispersed phase and the dispersing phase). In other words, the behavior of a dispersion that becomes inhomogeneous is highly complex, and its flow behavior is rather unpredictable without significant (experimental) investigation, possibly leading to unexpected stand stills of the ink liquid.

In this invention, when is referred to a concentration of "liquid developer dispersion" it refers to a concentration wherein the liquid developer dispersion has a solid content so that it can be used as such in a digital printing process. In other words, the liquid developer dispersion according to the invention has a solid content that is at working strength and does not require a dilution. A typical solid content of liquid developer dispersion is a solid content of between 10 to 30 wt %, such as a solid content of 25 wt %. According to this invention, "solid content" means the amount of marking particles in wt % with regard to the total liquid developer dispersion. According to this invention, "excess liquid developer dispersion" is the liquid developer dispersion that remains present on the surface of a member, such as the developing member, after a part of liquid developer dispersion has been transferred to another member, such as the imaging member.

In the context of the present invention, the liquid toner is a dispersion of marking particles in a carrier liquid. The marking particles, according to this invention, comprise coloured particles (also called ink particles or pigment) and a binder resin although non pigmented resin systems also can be used containing a phosphor or taggant or UV active material. Typically, the diameter of the marking particles is about 0.5 to 4.0 p.m. The marking particles have a concentration of about 40-95% of binder resin. The binder resin is a polymer, preferably transparent, that embeds the ink particles. Preferably, a polyester resin is used as binder resin. Also other types of resin having a very low or no compatibility with the carrier liquid and dispersing agent can be used. Preferably, the resin has a high transparency, provides good colour developing properties and has a high fixing property on the substrate. The carrier liquid according to the invention, can be any suitable liquid as is known in the art, and may be silicone fluids, hydrocarbon liquids and vegetable oils, or any combination thereof. The resin further can contain plasticizers or other material that can adjust the melt viscosity and Tg of the resin system. The toner also can contain compounds to adjust or increase the charging and transfer characteristics of the toner particle during print.

In the liquid developer dispersion of the invention, the pigment is typically melt mixed with possible other ingredients like waxes, plasticizers, and the binder resin into a pre-dispersion typically by extrusion and treated to provide suitably dimensions, for instance by dry milling. The binder resin is most suitably a polyester, which includes, in the context of the present invention, a polymer comprising ester functionality, such as a polyester copolymer. The dispersing agent, carrier liquid and marking particles are mixed into the liquid pre-dispersion, which is thereafter further processed, for instance by fluid milling like bead milling.

The concentration of toner particles (solid content) in excess liquid developer dispersion will vary depending on the amount of marking particles that need to be developed. The two most extreme situations of developing are that all the liquid developer dispersion is developed (100% page coverage), or none of the liquid developer dispersion is developed (0% page coverage). The latter results in a substrate without printed image of that colour. When no liquid developer dispersion is developed and all the marking particles remain on the developing member and thus reside in the excess liquid developer dispersion, the solid content is higher than in the liquid developer dispersion, particularly due to the partial removal of the carrier liquid containing some dispersing agent in the non-image areas. On the contrary, if all the liquid developer dispersion is developed, the excess liquid developer dispersion remaining on the developer roller will comprise almost no marking particles resulting in an excess liquid developer dispersion that mainly comprises carrier liquid containing also some dispersing agent. A person skilled in the art will understand that the solid content and the concentration of the carrier liquid in the excess liquid developer dispersion will vary between these two extremes depending on what needs to be developed. Typically, during the printing process a certain amount of carrier liquid is lost because it is highly unlikely that one prints continuously 100% page coverage all the time for all colours. Typically, the viscosity of the excess liquid developing dispersion is increased compared to the viscosity of the starting, i.e. 'fresh' liquid developing dispersion. The increase of the viscosity is due to the loss of carrier liquid and dispersing agent and due to caking. Caking causes a structural change in the liquid developing dispersion and has a significant contribution to the increase of viscosity of the excess liquid developer dispersion.

EXAMPLES

Various tests have been carried out in accordance with the invention.

Synthetic Example 1

Synthesis of Polyhydroxystearic Acid (PHSA)

In a 1 L flask equipped with a Dean-Stark apparatus and a reflux condenser, there are added 400 g of 12-hydroxyoctadecanoic acid (12-hydroxystearic acid), 1 ml titanium (IV) butoxide and 120 ml xylene. The reaction mixture is heated under nitrogen in an oil bath at 200° C., and refluxed for 30 h. The progress of the reaction can be monitored by the amount of separated water. The degree of condensation was determined by means of IR and titration. In the IR spectrum the carbonyl stretch ratio of the carboxylic acid and the ester is a measure of the degree of condensation. By means of titration, the acid value can be determined. In this example, 20 mg KOH/g was obtained, which is a value of 8 or 10 12-hydroxystearic acid (m=6-8) units and a weight-average molecular weight (Mw) of 2800 g/mol.

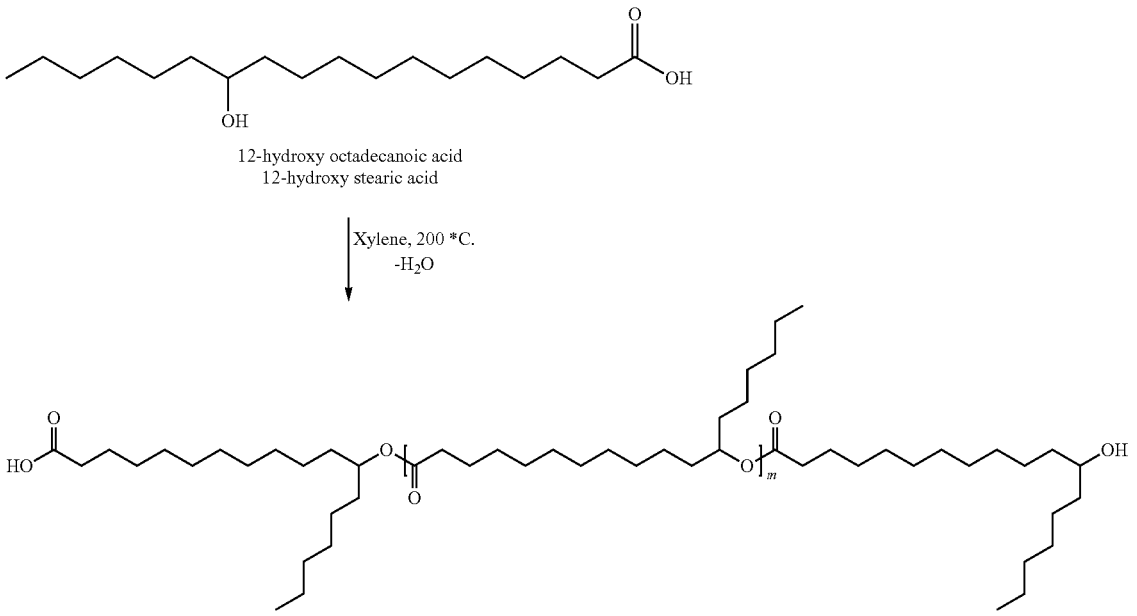

Poly(hydroxystearic acid) with another degree of polymerisation and other fatty acid polymers may be prepared in analogue manner. Generally, as mentioned before, the compound may be present in a degree of polymerisation of 1 (monomer) preferably up to 10. Furthermore, while in the used example, the hydroxylated fatty acid is a saturated fatty acid, more particularly stearic acid, it could alternatively be an unsaturated fatty acid or any other saturated fatty acid with a group capable of bonding with the acid group. Thus while hydroxylated fatty acids are most preferred, amino-substituted fatty acids are not excluded. Furthermore, the hydroxyl-function is present in this example in the center of the monomer. The center is here any position between atom 4 and 15 on the fatty acid chain, in this example at carbon atom 12. Preferably, the side chain defined in the repetitive unit has a length of at least C3, more preferably at least C4, such as butyl, pentyl, hexyl, heptyl or octyl. It is not excluded that the fatty acid chain itself is branched and that the resulting repetitive unit has a first and a second side chain.

Synthetic Example 2

Coupling of Polyethylenimine (PEI) with 12-Hydroxystearic Acid (PHSA) and Polyisobutylene Succinic Anhydride (PIBSA)

10.0 g polyethylenimine (Mw 800) was mixed with 11.9 g PIBSA (Mw 950) and stirred at room temperature for 30 minutes under a nitrogen flow. The temperature was raised to 160° C. and 35.0 g PHSA (Mw 2800) was added. The mixture was further heated under a nitrogen flow for additional 5 hours at 160° C. After cooling an oily substance is obtained that can be used as such. The reaction equation is shown in FIG. 2.

Test Methods

Viscosity

The viscosity of the liquid developer dispersion and carrier liquid is measured with a Haake Rheostress RS6000 operated in shear rate sweep from 0.1 to 3000 l/s at 25° C. The instrument is equipped with a cone/plate geometry type C60/1° and the gap is set to 0.052 mm. The viscosity is measured, on the basis of the operation in shear rate sweep, at a value of 0.88 l/s. The measurements are carried out at the beginning and after the caking test and at room temperature. The time lapsed in the caking test is sufficient to ensure a representative measurement.

Adhesion Test

The adhesion is a measure for the fusing degree and is measured by a tape test. A tape type Scotch Magic tape 19 mm of length 15 cm is put on the fused image and removed slowly under an angle of 90 to 150° C. The tape is visually inspected and the adhesion is ranked as follows 1: no toner left on the tape: OK 2: almost no toner left on the tape: acceptable 3: clear deposition of toner on the tape and/or almost no toner anymore on printed samples—unacceptable Caking As there are no standard measurement tools for caking as encountered in a liquid toner process, i.e. a liquid toner electro-photographic process, a test system was built consisting of a simplified version of the apparatus described in FIG. 1. The system comprises a liquid developer dispersion reservoir, a toner supply roller, a development roller, a thickening corona for toner compaction on the development roller and a polyurethane scraper blade to remove excess developer from the development roller. As the test system has no photoconductor, all toner applied to the development member is considered excess toner. Hence this test system makes it possible to perform worst-case caking experiments.

An anilox roll with a volume of 14 $cm^3/m^2$ was used as a toner supply roller. The development roller was made of rubber, which is a silicone rubber with a hardness 50 shore A. The test system was operated at 60 cm/s and the thickening corona was operated at 4 kV.

The caking level is evaluated by visual inspection of the toner on the scraper blade after a 2 hour test and ranked as follows:

0 refers to no caking, meaning that a very good result is obtained.

1, 2, or 3 refers to caking levels where small acceptable amounts of caking occurs, where 1 refers to a good result, 2 refers to a moderate result, and 3 refers to a result that is just acceptable.

4 refers to a caking level that is not acceptable.

5 refers to severe caking.

Test Examples

Several liquid developer dispersions are prepared and comprise a marking particle, a carrier liquid and a dispersing agent. A Marking particle was prepared by kneading a polyester resin. The ingredients used to prepare the marking particles and the liquid developer dispersions are summarized in table 1.

The marking particles are prepared by kneading the ingredient as mentioned in table 1 at a temperature of 100 to 120° C. for 45 minutes. This mixture is cooled down and milled down to 10 μm by a fluidized bed mill.

TABLE 1

| composition of marking particles | | | | | | |
|---|---|---|---|---|---|---|
| name | Polymer name | conc (w/w %) | Pigment name | conc (w/w %) | Additive name | conc (w/w%) |
| MAR1 | PM1 | 87.5 | PIG1 | 12.5 | | |
| MAR2 | PM1 | 81.5 | PIG1 | 12.5 | AD1 | 6 |

PM1 = polyester resin Tg = 60° C. and Tm = 100° C and acid value of 12 mg KOH/gr
PIG1 = copper phthalocyanine PB15:3 (Heliogen blau D7079)

AD1=toluene sulfonamide additive

Afterwards the liquid developer dispersions are prepared as mentioned in table 3 based on the dispersing agents as mentioned in table 2.

The dispersing agents were prepared in accordance with the synthetic examples 1 and 2 for DA5. The synthesis of the other dispersing agents was carried out in an analogous manner.

A pre-dispersion of the ingredients is made and stirred for 10 minutes at room temperature. The pre-dispersion is then brought into a bead mill to prepare the liquid developer dispersion. The liquid developer dispersions were milled down to a dv50 of 1.8 to 2 μm. The milling was done till the desired particle size, viscosity and conductivity was obtained.

| DA | PA MW | tail 1 MW | tail 1 type | tail 2 MW | ratio tail 1/tail 2 | total DA MW |
|---|---|---|---|---|---|---|
| Solsperse 13940 | | | | | 100/0 | |
| Solsperse 11000 | | | | | 100/0 | |
| DA1 | 10000 | 1600 | PHSA | 1000 | 95/5 | 105000 |
| DA2 | 25000 | 600 | PHSA | 1000 | 75/25 | 85000 |
| DA3 | 230 | 300 | HSA | 1000 | 30/70 | 3100 |
| DA4 | 800 | 1600 | PHSA | 1300 | 83/17 | 8500 |
| DA5 | 800 | 2800 | PHSA | 1000 | 75/25 | 4500 |
| DA6 | 230 | 300 | HSA | 1000 | 60/40 | 2750 |
| DA7 | 230 | 1900 | PHOA | 1000 | 66/34 | 3150 |
| DA8 | 5000 | 1200 | PHSA | 1000 | 50/50 | 25000 |

PA = polyamine
MW = molecular weight
PHSA = polyhydroxystearic acid
PHOA = polyhydroxyricinoleic acid In this table, MW refers to the weight-average molecular weight. The Solsperse 13940 and 11000 are polymeric dispersant in aliphatic distillate commercially available from Lubrizol Ltd. The Solsperse 13940 has a base equivalent of 520-660; the Solsperse 11000 has a base equivalent of 1300-1700. The base equivalent is defined as the amount of dispersing agent that is needed to neutralize 1 mol of acid.

Tail 1 refers to the first stabilizing group and tail 2 refers to the second stabilizing group. The ratio between tail 1 and tail 2 is defined as the weight ratio of the total weight of the first stabilizing groups and total weight of the second stabilizing groups. The second stabilizing group was in each example polyisobutylene, and the polyamine anchor group was in each example polyethyleneimine (PEI).

TABLE 3

| liquid developer dispersion composition | | | | | |
|---|---|---|---|---|---|
| | marking particles | | dispersing agent | | carrier liquid (1) |
| name | name | conc (w/w %) | name | conc (w/w %) | conc (w/w %) |
| LD1 | MAR2 | 35 | Solsperse 13940 | 3.5 | 61.5 |
| LD2 | MAR2 | 35 | Solsperse 11000 | 3.5 | 61.5 |
| LD3 | MAR2 | 35 | DA1 | 5 | 60 |
| LD4 | MAR2 | 35 | DA2 | 3.8 | 61.2 |
| LD5 | MAR2 | 35 | DA3 | 3.25 | 61.75 |
| LD6 | MAR1 | 35 | DA4 | 3 | 62 |
| LD7 | MAR1 | 35 | DA5 | 3 | 62 |
| LD8 | MAR1 | 35 | DA6 | 5 | 60 |
| LD9 | MAR2 | 35 | DA7 | 3.25 | 61.75 |
| LD10 | MAR2 | 40 | DA8 | 4 | 56 |

(1) mineral oil with a viscosity at 25° C. of 6 mPas

With the liquid developer dispersion LD1 to LD10 caking tests were performed and images were print by diluting LD1 to LD10 to a solid content of 25%. The images were printed with an optical density from 1.4 to 1.6 with an engine as described in EP12175762 at a speed of 60 m/min. The fusing step was modified in such a way that the electrostatically transferred image from the intermediate roller to the substrate is fed to a fusing station, which contains a non-contact infrared zone. The infrared heater was equipped with ceramic tiles (Elstein type) to emit IR. The temperature of the tiles was adjusted to obtain a substrate temperature between 100 and 120° C. The heat resulting from the infrared radiation accomplishes coalescence of the liquid developer dispersion and the adhesion to the substrate. Three heated roller pairs were located downstream of the infrared zone. The heated rollers were operating between 110 and 130° C. On the heated rollers a scraper is mounted to collect the separated carrier liquid.

In this way, the roller pairs allow adjustment of the adhesion strength and gloss of the ink. Moreover, they contribute to collecting of the separated carrier liquid for reuse.

TABLE 4

| results | | | | | | |
|---|---|---|---|---|---|---|
| toner | DA | visco (1) | visco (2) | caking (3) | tapetest | type |
| LD1 | sols13940 | 90 | 1400 | 5 | 1 | comp |
| LD2 | sols11000 | 45 | 1200 | 4 | 3 | comp |
| LD3 | DA1 | 75 | 726 | 2 | 2 | inv |
| LD4 | DA2 | 95 | 970 | 3 | 1 | inv |
| LD5 | DA3 | 67 | 463 | 1 | 2 | inv |

TABLE 4-continued

| results | | | | | | |
|---|---|---|---|---|---|---|
| toner | DA | visco (1) | visco (2) | caking (3) | tapetest | type |
| LD6 | DA4 | 90 | 786 | 2 | 1 | inv |
| LD7 | DA5 | 120 | 548 | 2 | 2 | inv |
| LD8 | DA6 | 143 | 575 | 2 | 1 | inv |
| LD9 | DA7 | 98 | 727 | 2 | 2 | inv |
| LD10 | DA8 | 175 | 433 | 1 | 2 | inv |

(1)measured at shear rate of 0.88 1/s at start of the caking test;
(2)measured at shear rate of 0.88 1/s at end of the caking test, at room temperature (25 degrees Celsius);
(3)visual observation of caking at end of the caking test.

The results demonstrate that a good caking behavior and a good fusing properly are obtained with the liquid developer dispersions (LD3 to LD10) that have both a fatty acid compound and an alkylene compound as stabilizing groups. The caking issue is reduced significantly by means of using dispersing agents with the first and the second stabilizing groups. In order to optimize the fusing behavior, it may be beneficial to apply dispersing agents with an anchor group of relatively low molecular weight. Preferably, the anchor group is a polyamine with a molecular weight of less than 10,000 g/mol.

The invention claimed is:

1. A liquid toner dispersion provided with marking particles comprising a pigment and a polyester based resin, said dispersion comprising a nonpolar organic carrier liquid and a hyper-dispersant comprising a graft copolymer provided with an anchor group comprising an amine-functionalized polymer onto which stabilizing groups are grafted, which anchor group is anchored on a surface of a marking particle, wherein a first stabilizing group and a second stabilizing group are grafted to the anchor group, wherein the first stabilizing group is a hydroxylated fatty acid compound and the second stabilizing group is polyolefin that is modified with a reactive linkage group.

2. The liquid toner dispersion as claimed in claim 1, wherein the polyolefin is derived from branched monomers.

3. The liquid toner dispersion as claimed in claim 2, wherein the branched monomer is isobutylene.

4. The liquid toner dispersion as claimed in claim 1, wherein the hydroxylated fatty acid compound is an oligomer with a degree of polymerisation of 2-10.

5. The liquid toner dispersion as claimed in claim 4, wherein the oligomer has a degree of polymerisation of 2-5.

6. The liquid toner dispersion as claimed in claim 1, wherein the fatty acid compound is a monomer.

7. The liquid toner dispersion as claimed in claim 1, wherein at least one of the stabilizing groups coupled to the anchor group has a molecular weight of at least 800 g/mol.

8. The liquid toner dispersion as claimed in claim 1, wherein the anchor group has a weight-average molecular weight in the range of less than 10,000 g/mol.

9. The liquid toner dispersion as claimed in claim 8, wherein the anchor group has a weight-average molecular weight of at most 1500 g/mol.

10. The liquid toner dispersion as claimed in claim 1, wherein the amine-functionalized polymer is chosen from the group of polyethyleneimine and polyallylamine.

11. The liquid toner dispersion as claimed in claim 1, wherein the copolymer has a weight-average molecular weight in the range of 1500-40,000 g/mol.

12. The liquid toner dispersion as claimed in claim 11, wherein the copolymer has a weight-average molecular weight in the range of 3000-10,000 g/mol.

13. The liquid toner dispersion as claimed in claim 1, wherein at least one of the fatty acid compound species grafted as a stabilizing group onto the anchor group have a molecular weight in the range of 500-2000 g/mol.

14. The liquid toner dispersion as claimed in claim 1, wherein the weight ratio of the first and the second stabilizing groups is in the range of 0.25-2.

15. The liquid toner dispersion as claimed in claim 1, wherein the hydroxylated fatty acid compound is derived from a hydroxylated fatty acid with a chain length in the range of C12-C26.

16. A method of preparing a liquid toner dispersion provided with marking particles comprising a pigment and a polyester based resin, said dispersion comprising a nonpolar organic carrier liquid and a hyper-dispersant comprising a graft copolymer provided with an anchor group comprising an amine-functionalized polymer onto which stabilizing groups are grafted, which anchor group is anchored on a surface of a marking particle, comprising the steps of:

preparing the amine functionalized polymer;

preparing the graft copolymer comprising the steps of coupling a polyolefin modified with a reactive linkage group onto the amine-functionalized polymer, and coupling a hydroxylated fatty acid compound onto the amine-functionalized polymer; and mixing the hyper-dispersant with the nonpolar organic carrier liquid and marking particles.

17. The method as claimed in claim 16, wherein the grafting of the hydroxylated fatty acid compound comprises a first step, wherein an acid-base pair of the hydroxylated fatty acid compound and the amine-functionalized polymer is formed, and a second step, wherein the acid-base pair is converted into the polymer.

18. The method as claimed in claim 16, wherein the polyolefin grafted onto the amine-functionalized polymer is branched.

19. A method of digitally printing a liquid toner dispersion, wherein use is made of a first member that rotates and is in rotational contact with a further member during printing, which printing method comprises the steps of:

charging a liquid toner dispersion as claimed in claim 1 to facilitate transfer thereof from the first member to the further member;

transferring the charged liquid toner dispersion from a surface of the first member via the at least one further member to a substrate, wherein excess liquid toner dispersion remains present on the first member after said transfer, and wherein the liquid toner dispersion is fused to obtain a fused film on the substrate, and;

removing, at least substantially, the excess liquid toner dispersion from the surface of the first member by means of a removal device.

* * * * *